US009458529B2

(12) United States Patent
Sawada

(10) Patent No.: US 9,458,529 B2
(45) Date of Patent: Oct. 4, 2016

(54) HIGH-HARDNESS SHOT MATERIAL FOR SHOT PEENING AND SHOT PEENING METHOD

(75) Inventor: Toshiyuki Sawada, Himeji (JP)

(73) Assignee: Sanyo Special Steel Co., Ltd., Himeji-shi, Hyogo-ken (JP)

( * ) Notice: Subject to any disclaimer, the term of this patent is extended or adjusted under 35 U.S.C. 154(b) by 668 days.

(21) Appl. No.: 13/082,577

(22) Filed: Apr. 8, 2011

(65) Prior Publication Data

US 2011/0265535 A1 Nov. 3, 2011

(30) Foreign Application Priority Data

Apr. 9, 2010 (JP) ..... 2010-90055
Feb. 7, 2011 (JP) ..... 2011-23623

(51) Int. Cl.
*C22C 38/32* (2006.01)
*C21D 7/06* (2006.01)

(52) U.S. Cl.
CPC ..... *C22C 38/32* (2013.01); *C21D 7/06* (2013.01)

(58) Field of Classification Search
CPC ..... C22C 38/00; C22C 38/32; C22C 38/54; C21D 7/00; C21D 7/06
USPC ..... 72/53; 29/90.7, 899, 34, 413, 417, 29/898.069; 102/448; 86/57
See application file for complete search history.

(56) References Cited

U.S. PATENT DOCUMENTS

| | | | | |
|---|---|---|---|---|
| 3,970,445 | A * | 7/1976 | Gale et al. | 420/64 |
| 4,194,900 | A * | 3/1980 | Ide et al. | 75/255 |
| 4,526,618 | A * | 7/1985 | Keshavan et al. | 106/1.05 |
| 5,758,531 | A * | 6/1998 | Graf | 72/53 |
| 6,224,686 | B1 * | 5/2001 | Aoki et al. | 148/230 |
| 6,658,907 | B2 | 12/2003 | Inoue et al. | |
| 6,780,139 | B2 * | 8/2004 | Misada et al. | 476/73 |
| 6,858,096 | B2 * | 2/2005 | Kino et al. | 148/219 |
| 2002/0119858 | A1 * | 8/2002 | Kino et al. | 475/204 |
| 2003/0013574 | A1 * | 1/2003 | Misada et al. | 476/40 |
| 2005/0061402 | A1 * | 3/2005 | Sandur | 148/219 |
| 2009/0100658 | A1 * | 4/2009 | Kobayashi | 29/90.7 |

FOREIGN PATENT DOCUMENTS

| | | | |
|---|---|---|---|
| JP | 8323626 | A | 12/1996 |
| JP | 200236115 | A | 2/2002 |
| JP | 2002317203 | A | 10/2002 |
| JP | 200784858 | A | 4/2007 |

* cited by examiner

*Primary Examiner* — David Bryant
*Assistant Examiner* — Lawrence Averick
(74) *Attorney, Agent, or Firm* — The Webb Law Firm

(57) ABSTRACT

A high hardness, high toughness and inexpensive shot material for shot peening is provided. The high-hardness shot material for shot peening comprises, in mass %, 5 to 8% of B; 0.05 to 1% of C; 0 to 25% of Cr; balance Fe and inevitable impurities. B and C are contained in a total amount of 8.5% or less.

6 Claims, No Drawings

HIGH-HARDNESS SHOT MATERIAL FOR SHOT PEENING AND SHOT PEENING METHOD

CROSS-REFERENCES TO RELATED APPLICATIONS

This application claims priority to Japanese Patent Application No. 2010-90055 filed on Apr. 9, 2010 and Japanese Patent Application No. 2011-23623 filed on Feb. 7, 2011, the entire contents of which are incorporated herein by reference.

1. Technical Field

This invention relates to a high-hardness shot material for shot peening and to a shot peening method.

2. Background Art

Generally, shot peening is an effective surface treatment technique which can improve fatigue strength of a material by shooting particles, called "shot material", against the surface of the material to provide a compressive residual stress, and is applied to automobile parts, such as springs and gears, or even to materials for molds. In recent years, as workpieces, such as gears which underwent carburizing and quenching, are getting harder, shot materials for those materials are also required to possess higher hardness. In other words, shot peening with low-hardness shot materials cannot provide a high compressive residual stress to the surface of high-hardness workpieces.

In addition, a demand for further weight reduction in automobile parts and the like makes it necessary to conduct shot peening to increasingly harder materials, causing a demand for shot materials with even higher hardness. For example, although the high-hardness shot materials include ceramic shot materials, such as zirconia beads and alumina beads, these ceramics are more brittle than metal powder and easy to crumble during shot peening, causing a problem of short lifetime as shot materials.

To the above problems, as disclosed, for example, in Japanese Patent Laid-Open Publication No. H8-323626 (Patent Literature 1), super-hard shot materials having high hardness to such an extent of more than 1400 HV and high toughness are proposed which employ carbides, such as hafnium carbides, tantalum carbides and tungsten carbides; nitrides, such as hafnium nitrides and tantalum nitrides; borides, such as hafnium borides, tantalum borides and tungsten borides; composite compounds and solid solutions thereof, super-hard alloys and cermets mainly composed thereof, and the like. However, these shot materials are far more expensive than the conventional shot materials made from cast steel.

In addition, as disclosed in Japanese Patent Laid-Open Publication No. 2002-36115 (Patent Literature 2), iron-based amorphous shot materials having high hardness and high toughness are proposed. However, the upper limit of the hardness is 1100 HV with the highest value in the examples being 1000 HV, leading to a problem that it is quite difficult to produce a metal powder having a hardness of more than 1100 HV.

On the other hand, cermet is known as a material in which high-hardness ceramic phases are bound by a high-toughness metal phase. However, since cermet is generally produced by granulation and sintering, its production cost will be expensive when compared with the cases of using atomization method and the like. In addition, although atomization method and the like are methods which are capable of producing powder in large quantity at low cost, there is a problem that it is impossible to produce high-melting-point ceramics such as WC and TiC due to the involvement of the melting in a refractory.

In order to solve a problem as described above, the applicants proposed, as an inexpensive shot material having high hardness and toughness, an iron-based high-hardness shot material comprising 5 to 8% by mass of boron (B), which is produced by atomization method or quenched-ribbon pulverization method, and consists of 50 to 90% by area of an $Fe_2B$-based boride and 10 to 50% by area of a solid solution based on bcc and/or fcc iron, as disclosed in Japanese Patent Laid-Open Publication No. 2007-84858 (Patent Literature 3). This shot material is superior in that it may have a microstructure in which $Fe_2B$ is bound by a eutectic texture, has high hardness and toughness, and can be produced at a practical level of cost. There is, however, still a demand for further increasing hardness of shot material.

CITATION LIST

Patent Literature

[PTL 1] Japanese Patent Laid-Open Publication No. H8-323626

[PTL 2] Japanese Patent Laid-Open Publication No. 2002-36115

[PTL 3] Japanese Patent Laid-Open Publication No. 2007-84858

SUMMARY OF INVENTION

The applicants have now found that addition of carbon (C) is effective for achieving a far higher hardness and that, at the same time, a high toughness can also be attained by regulating the total additive amount of carbon (C) and boron (B).

It is therefore an object of the present invention to provide a high hardness, high toughness and inexpensive shot material for shot peening and a method for using the shot peening material.

According to an aspect of the present invention, there is provided a high-hardness shot material for shot peening comprising in mass %:

B: 5 to 8%;

C: 0.05 to 1%;

Cr: 0 to 25%;

balance Fe and inevitable impurities, wherein B and C are contained in a total amount of 8.5% or less.

According to another aspect of the present invention, there is provided a method for shot peening, comprising the step of shooting the high-hardness shot material against a surface of a workpiece, thereby providing the workpiece with a compressive residual stress to improve fatigue strength of the workpiece.

DESCRIPTION OF EMBODIMENTS

As described above, the features of the present invention are to achieve far higher hardness by using Fe as a main component and adding 5 to 8% of B to provide a hypereutectic texture of an iron-based solid solution phase and $Fe_2B$ phase, and also by adding C to the texture. In addition, it has been found that an unexpected effect of improving powder production yield is also attained in production of a powder through atomization method, as the powder recovery rate in terms of the charged amount of molten base material becomes higher than that of an alloy to which no C is added. While the detailed cause of this effect is uncertain, it is assumed that the addition of C lowers the viscosity of the molten alloy through deoxidization or the like to reduce adhesion of the molten alloy to the refractory on the furnace wall of the atomizer.

Moreover, in general, when a powder is produced by atomization method, pores may be formed inside the powder, as is thought to be caused during solidification process by gasification of gasifying components which have been dissolved into the molten alloy. Therefore, the resultant mixture partly includes particles having pores inside. When a powder weighed out from a lot having a high proportion of the particles with inner pores is used as a shot material for shot peening, the shot material will easily crumble from the pores due to collisions with the workpiece, resulting in intense consumption of the powder. However, addition of C lowers the ratio of forming the particles with inner pores, and thus makes it possible to reduce the consumption of the powder used as a shot material. The detailed mechanism for this phenomenon is uncertain, but is assumed to be, as described above, that the addition of C reduces the amount of the gasifying components in the molten alloy, for example, by deoxidizing the molten alloy during atomization.

The high-hardness shot material for shot peening of the present invention comprises, preferably consists of, in mass %, 5 to 8% of B; 0.05 to 1% of C; 0 to 25% of Cr; balance Fe and inevitable impurities, such that B and C are contained in a total amount of 8.5% or less.

Essential Elements

In the alloy of the present invention, B is an essential element for forming $Fe_2B$ to achieve high hardness, and is contained in an amount of 5 to 8%. B content of less than 5% results in insufficient hardness, while B content of more than 8% results in brittleness of the alloy.

In the alloy of the present invention, C is an essential element which has an effect of increasing hardness and improves powder production yield, and is contained in an amount of 0.05 to 1%, preferably 0.08 to 0.7%, more preferably 0.1 to 0.3%. C content of less than 0.05% fails to provide such effects, while C content of more than 1% results in brittleness of the alloy.

In the alloy of the present invention, both B and C are essential elements for increasing hardness, but the total content of more than 8.5% leads to brittleness of the alloy. Thus, the upper limit of the total content of B and C is set to be 8.5%.

Optional Element

Cr is an element which is effective for improving corrosion resistance, and may be added up to 25%, preferably in an amount of 5 to 20%, depending on necessity. While shot materials are often stored in the atmosphere and needed to be kept rustless under conditions in storage and use, addition of Cr is preferred when there is a particular concern with rusting. However, since Cr addition in an amount of more than 25% causes clogging in a nozzle during atomization, the upper limit is set to be 25%.

EXAMPLES

The present invention is explained in detail below with reference to examples. A raw material which was formulated to have each composition shown in Table 1 was subjected to induction melting in Ar gas in a crucible made of refractory material, from which the molten material was tapped through a tap nozzle positioned on the bottom part of the crucible, followed by nitrogen gas atomization to produce a powder. In addition, a powder having each composition shown in Table 1 except that C was not added was prepared as a comparative material with regard to the corresponding C-added composition.

Evaluation 1: Vickers Hardness

The resultant powder was classified to have particle sizes in the range of from 45 to 125 μm, and then embedded into a resin and polished to prepare a specimen, of which the hardness was measured by a micro-Vickers hardness tester. At this time, each powder was compared for hardness with the corresponding powder having the same composition except that C was not added. Specimen which exhibited an increase of 50 HV or more by the C-addition was labeled as "A," while specimen which exhibited an increase in hardness of less than 50 HV was labeled as "B." The obtained results are shown in Table 1.

Evaluation 2: Crack Initiation Load

Crack initiation load was also evaluated by using the above-mentioned specimen embedded in resin, applying an impression under a load varying from 200 to 1000 g with a micro-Vickers hardness tester, and measuring the load when a crack was initiated. Powder which exhibited a low crack initiation load was determined to be brittle, according to the criteria that 500 g or more is "A" and 300 g or less is "B." The obtained results are shown in Table 1.

Evaluation 3: Recovered-Amount/Charged-Amount

Powder production yield was evaluated on the basis of the ratio of the amount of the recovered powder to that of the raw material charged for atomization (hereinafter, "recovered-amount/charged-amount"). At this time, each powder was compared for recovered-amount/charged-amount with the corresponding powder having the same composition except that C was not added. Those exhibited an increase in yield of 10% or more by the C-addition was labeled as "A," while those exhibited an increase in yield of less than 10% was labeled as "B." The obtained result is shown in Table 1.

Evaluation 4: Corrosion Resistance

For corrosion resistance, a humidity cabinet test was conducted under the conditions that the powder was spreaded over a double-sided tape attached to a glass plate and then was exposed for 96 hours to an atmosphere having a temperature of 70° C. and a humidity of 95%. Specimen which gave rise to no rust was labeled as "AA," while specimen which gave rise to rust only in part was labeled as "A." The obtained result is shown in Table 1.

TABLE 1

| | Composition (mass %) | | | | | Hardness | Crack | Recovered-Amount/ | Corrosion | |
|---|---|---|---|---|---|---|---|---|---|---|
| No | B | C | Cr | B + C | Fe | (HV) | Initiation Load | Charged-Amount | Resistance | |
| 1 | 5.0 | 1 | — | 5.1 | balance | A | A | A | A | Present |
| 2 | 6.0 | 0.5 | — | 6.5 | balance | A | A | A | A | Invention |
| 3 | 7.0 | 0.1 | — | 7.1 | balance | A | A | A | A | Examples |
| 4 | 8.0 | 0.05 | — | 8.05 | balance | A | A | A | A | |

TABLE 1-continued

| No | Composition (mass %) B | C | Cr | B + C | Fe | Hardness (HV) | Crack Initiation Load | Recovered-Amount/ Charged-Amount | Corrosion Resistance | |
|---|---|---|---|---|---|---|---|---|---|---|
| 5 | 5.0 | 0.7 | — | 5.7 | balance | A | A | A | A | |
| 6 | 5.0 | 0.5 | — | 5.5 | balance | A | A | A | A | |
| 7 | 5.0 | 0.1 | — | 5.1 | balance | A | A | A | A | |
| 8 | 5.0 | 0.05 | 10 | 5.05 | balance | A | A | A | AA | |
| 9 | 7.0 | 0.1 | 17 | 7.1 | balance | A | A | A | AA | |
| 10 | 8.0 | 0.1 | 20 | 8.1 | balance | A | A | A | AA | |
| 11 | 6.0 | 0.5 | 5 | 6.5 | balance | A | A | A | AA | |
| 12 | 6.0 | 0.5 | 15 | 6.5 | balance | A | A | A | AA | |
| 13 | 6.0 | 0.5 | 25 | 6.5 | balance | A | A | A | AA | |
| 14 | 4.0 | 0.5 | — | 4.5 | balance | A | A | A | A | Comparative Examples |
| 15 | 9.0 | 0.5 | — | 9.5 | balance | A | B | A | A | |
| 16 | 5.0 | 0.01 | — | 5.01 | balance | B | A | B | A | |
| 17 | 8.0 | 0.01 | — | 8.01 | balance | B | A | B | A | |
| 18 | 7.0 | 1.2 | — | 8.2 | balance | A | B | A | A | |
| 19 | 8.0 | 1.0 | — | 9.0 | balance | A | B | A | A | |
| 20 | 6.0 | 0.5 | 30 | 6.5 | balance | — | — | — | — | |

Note)
Underlined values fail to satisfy the conditions of the present invention.

As shown in Table 1, Nos. 1 to 13 are examples of the present invention and Nos. 14 to 20 are comparative examples.

As shown in Table 1, comparative example No. 14 was found to have exhibited an improvement in hardness of 50 HV or more and an improvement in the ratio of the recovered amount and the charged amount (hereinafter, "recovered-amount/charged-amount") of 10% or more when compared with the corresponding sample to which no C was added, as well as a crack initiation load of 500 g or more, but resulted in a low absolute value of hardness of 900 HV due to a low B content of 4%. Comparative example No. 15 resulted in a low crack initiation load due to a B content as high as 9% and a total content of B and C as high as 9.5%.

Comparative example Nos. 16 and 17 exhibited insufficient improvements in hardness and recovered-amount/charged-amount when compared with the corresponding samples to which no C was added, due to the low C content of 0.01%, as assumed in paragraph [0011]. Comparative example Nos. 18 and 19 both exhibited low crack initiation loads due to the high C content of No. 18 and the high total amount of B and C of No. 19, respectively. For comparative example No. 20, evaluation could not be conducted because the high Cr content of 30% caused a clogging in the nozzle during atomization, which made it impossible to produce powder.

Present invention example Nos. 1 to 13 were all found to have exhibited improvements in hardness of 50 HV or more and improvements in the ratio of recovered-amount/charged-amount of 10% or more, when compared with the corresponding alloy powders having the same compositions except that C was not added. In addition, the crack initiation loads were also found to be as high as 500 g or more. On the other hand, present invention example Nos. 8 to 13 were found to be superior in corrosion resistance when compared with the corresponding samples to which no Cr was added.

In view of the above, industrially excellent effects are provided according to the present invention in that the C-addition makes it possible to achieve higher hardness than before, reduce consumption of shot materials and improve powder production yield, as well as in that regulating the upper limit of the total amount of B and C restrains brittleness to enable low-cost production of the shot material having high toughness.

The invention claimed is:

1. A high-hardness shot material for shot peening comprising in mass %:

B: 5 to 8%;

C: 0.05 to 1%;

Cr: 0 to 20 %;

balance Fe and inevitable impurities, and having a hypereutectic structure comprising an iron-based solid solution phase and an $Fe_2B$ phase, wherein Fe is contained in an amount of 71.9 mass % or more, and B and C are contained in a total amount of 8.5% or less.

2. The high-hardness shot material according to claim 1, comprising Cr in an amount of more than 0% and not more than 20%.

3. A method for shot peening, comprising the step of shooting the high-hardness shot material according to claim 2 against a surface of a workpiece, thereby providing the workpiece with a compressive residual stress to improve fatigue strength of the workpiece.

4. The high-hardness shot material according to claim 1, comprising Cr in an amount of 5 to 20%.

5. A method for shot peening, comprising the step of shooting the high-hardness shot material according to claim 4 against a surface of a workpiece, thereby providing the workpiece with a compressive residual stress to improve fatigue strength of the workpiece.

6. A method for shot peening, comprising the step of shooting the high-hardness shot material according to claim 1 against a surface of a workpiece, thereby providing the workpiece with a compressive residual stress to improve fatigue strength of the workpiece.

* * * * *